United States Patent [19]

Kellogg

[11] 4,195,890

[45] Apr. 1, 1980

[54] SHELF APPARATUS WITH REMOVABLE DOOR ASSEMBLY

[76] Inventor: Harlan F. Kellogg, 1617 Sprucewood, Rockford, Ill. 61107

[21] Appl. No.: 936,339

[22] Filed: Aug. 24, 1978

[51] Int. Cl.[2] ..... A47B 43/00

[52] U.S. Cl. ..... 312/257 R; 312/107; 312/138 R

[58] Field of Search ..... 312/257 R, 257 SK, 257 A, 312/138 R, 107, 111, 324, 322, 323, 294, 326; 49/380

[56] References Cited

U.S. PATENT DOCUMENTS

| | | | |
|---|---|---|---|
| 840,061 | 1/1907 | Hofman | 312/322 |
| 845,829 | 3/1907 | Tacke | 312/138 R |
| 1,061,008 | 5/1913 | Pitt | 312/138 R |
| 2,988,414 | 6/1961 | Crowe et al. | 312/326 |
| 3,060,522 | 10/1962 | Parker | 49/380 |
| 3,162,498 | 12/1964 | Galati et al. | 312/323 |
| 3,300,078 | 1/1967 | Stanback | 312/257 R |
| 3,567,301 | 3/1971 | Dary | 312/257 R |
| 3,964,810 | 6/1976 | Murphy | 312/257 R |
| 4,056,295 | 11/1977 | Downing | 312/107 |
| 4,073,554 | 2/1978 | Oder et al. | 312/111 |

*Primary Examiner*—Victor N. Sakran
*Attorney, Agent, or Firm*—Morsbach & Pillote

[57] ABSTRACT

A shelf apparatus including upper and lower shelves and upright shelf supports attached to the shelves and extending therebetween to support the shelves in fixed vertically spaced relation, and a removable door assembly including an upright door mounting member movably positioned between the upper and lower shelves alongside one of the shelf supports and having upper and lower shelf engaging abutments, at least one of which is manually adjustable to forcibly increase the spacing between the upper and lower shelf engaging abutments to jam the door mounting member vertically between the upper and lower shelves, and a door mounted on the door mounting member for movement relative thereto. The door can be hingedly mounted on the door mounting member for swinging movement relative thereto on an upright axis. Alternatively, the door can be mounted for combination swinging movement about a horizontal axis between an upright and generally horizontal position and sliding movement between the shelves to a storage position.

16 Claims, 13 Drawing Figures

Fig. 10.
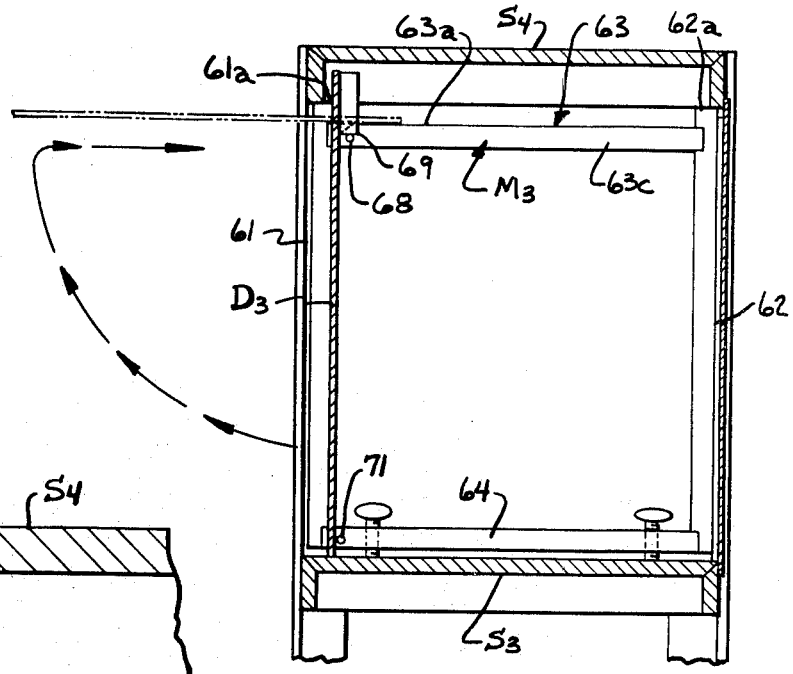
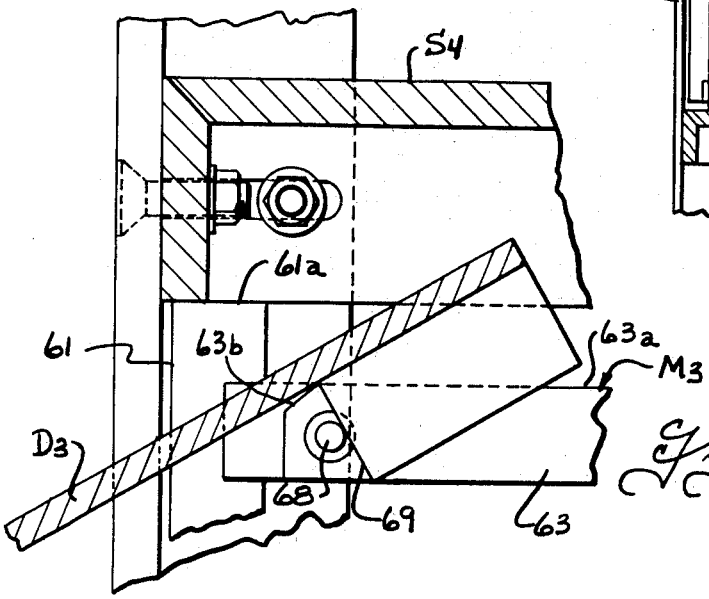
Fig. 11.
Fig. 12.
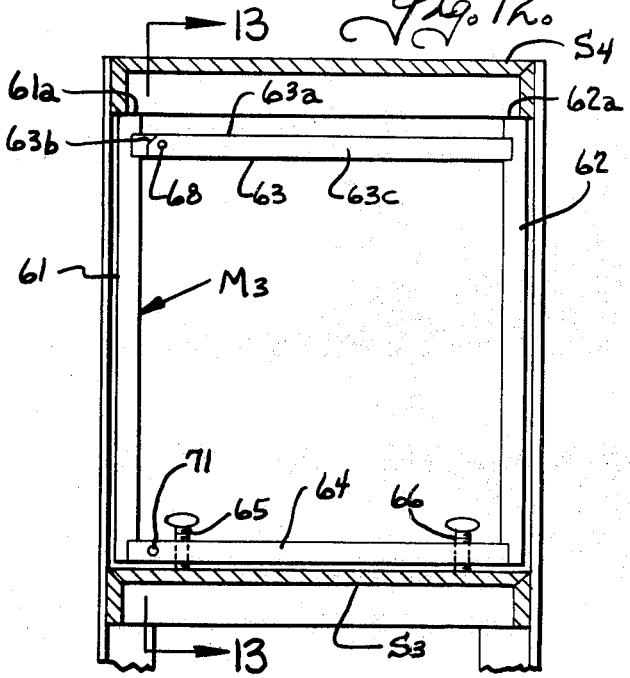
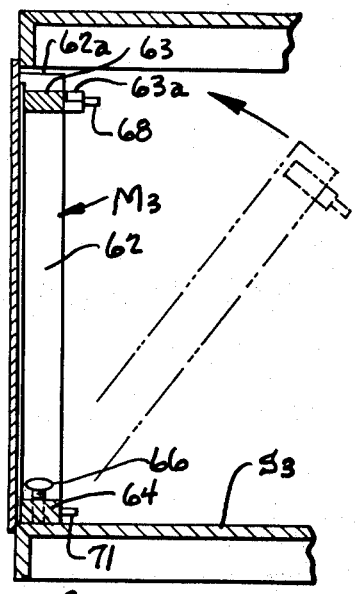
Fig. 13.

SHELF APPARATUS WITH REMOVABLE DOOR ASSEMBLY

SUMMARY OF THE INVENTION

The present invention relates to a shelf apparatus and a removable door assembly for closing one or more shelf openings in the shelf apparatus.

Various important objects of this invention are to provide a shelf apparatus with a removable door assembly in which the removable door assembly can be installed and removed without the use of special tools; and which removable door assembly does not require modification in the construction of the shelf apparatus or the drilling of holes for installation in the shelf apparatus so that the appearance of the shelf apparatus is not adversely affected when the door assembly is removed.

Accordingly, the present invention provides a shelf apparatus including spaced shelves interconnected in fixed vertically spaced relation by upright shelf supports, and a removable door assembly including an upright door mounting means removably positioned between the shelves alongside one of the shelf supports and having upper and lower shelf engaging abutment means adapted to engage opposed surfaces on the spaced shelves, manually operable means for adjustably and forcibly increasing the spacing between the upper and lower shelf engaging abutment means to jam the door mounting means vertically between the shelves, and a door mounted on the door mounting means for movement relative thereto.

In one embodiment of the removable door assembly, the door is hingedly mounted on the upright door mounting means for swinging movement into and out of a closed position at the front face of the shelf apparatus.

In another embodiment of the removable door assembly, the door is mounted for combined swinging movement about a horizontal axis from an upright position to a generally horizontal position, and for sliding movement when in the horizontal position to a storage position between the shelves.

These, together with other objects, features and advantages of the present invention will be more readily understood by reference to the following detailed descriptions, when taken in connection with the accompanying drawings wherein:

FIG. 10 is a fragmentary vertical sectional view taken on the plane 10—10 of FIG. 1;

FIG. 11 is a fragmentary vertical sectional view illustrating the parts on a larger scale;

FIG. 12 is a fragmentary vertical sectional view through the shelf apparatus and illustrating installation of the door mounting means for the combination swinging and sliding door in the shelf apparatus; and FIG. 13 is a fragmentary longitudinal sectional view taken on the plane 13—13 of FIG. 12.

Figure 7:
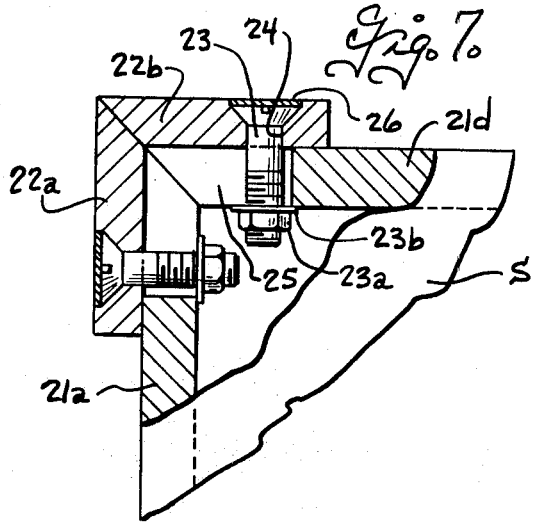
FIG. 7 is a fragmentary horizontal sectional view through a shelf and a shelf support post, illustrating the manner of connecting the same.

Reference is now made more specifically to the accompanying drawings wherein there is illustrated a shelf apparatus having different embodiments of the removable door assembly mounted thereon. The shelving assembly can comprise any number of shelves $\underline{S}$ and, in the embodiment illustrated, four selves designated $\underline{S}_1$–$\underline{S}_4$ are provided. The shelves are supported in fixed spaced relation by shelf support posts $\underline{P}$ and, in the embodiment shown, four corner posts designated $\underline{P}_1$–$\underline{P}_4$ are provided and attached to the shelves at the four corners thereof. The shelves are similarly constructed and are each preferably formed with a depending marginal flange including flanges 21*a* and 21*b* at the front and rear side edges, flanges 21*c* and 21*d* at the end edges of the shelf. The posts $\underline{P}_1$–$\underline{P}_4$ are also of like construction and each have angularly related legs 22*a* and 22*b* that overlie the flanges on the side and end edges of the shelves adjacent the corners. As best shown in FIG. 7, the legs of the posts are attached to the shelves by threaded fasteners such as bolts 23 that extend through openings 24 in the legs 22*a* and 22*b* of each post and through opeings 25 in the flanges of the shelves. The openings 24 in the legs are countersunk as shown in FIG. 7 to receive the heads of the bolts and a decorative cover piece 26, and the openings 25 in the flanges of the shelves can either be in the form of bolt openings or in the form of slots that open at the corners of the shelves, as shown in FIG. 7. Nuts 23*a* and washers 23*b* are provided on the bolts 23 to hold the shelves and legs in assembled relation.

Figure 1:
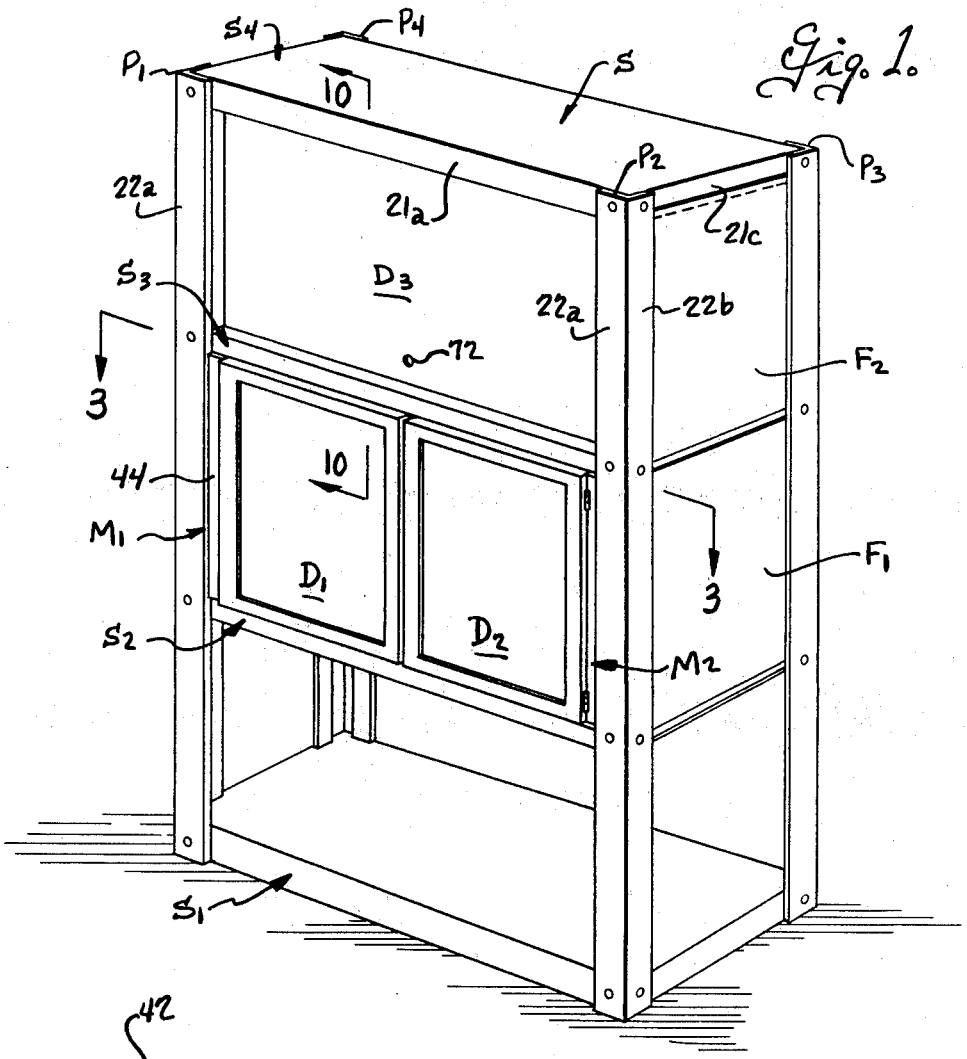
FIG. 1 is a perspective view of a shelf apparatus having two different removable door assemblies mounted thereon.
Figure 2:
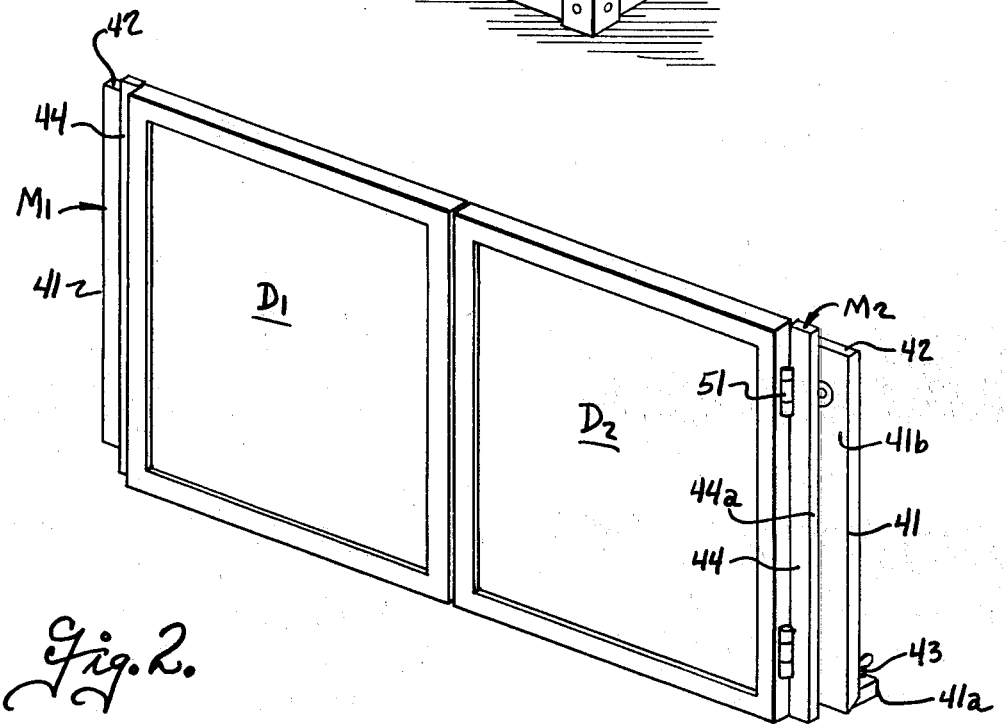
FIG. 2 is a perspective view of a pair of vertically hinged removable door assemblies.
Figure 3:
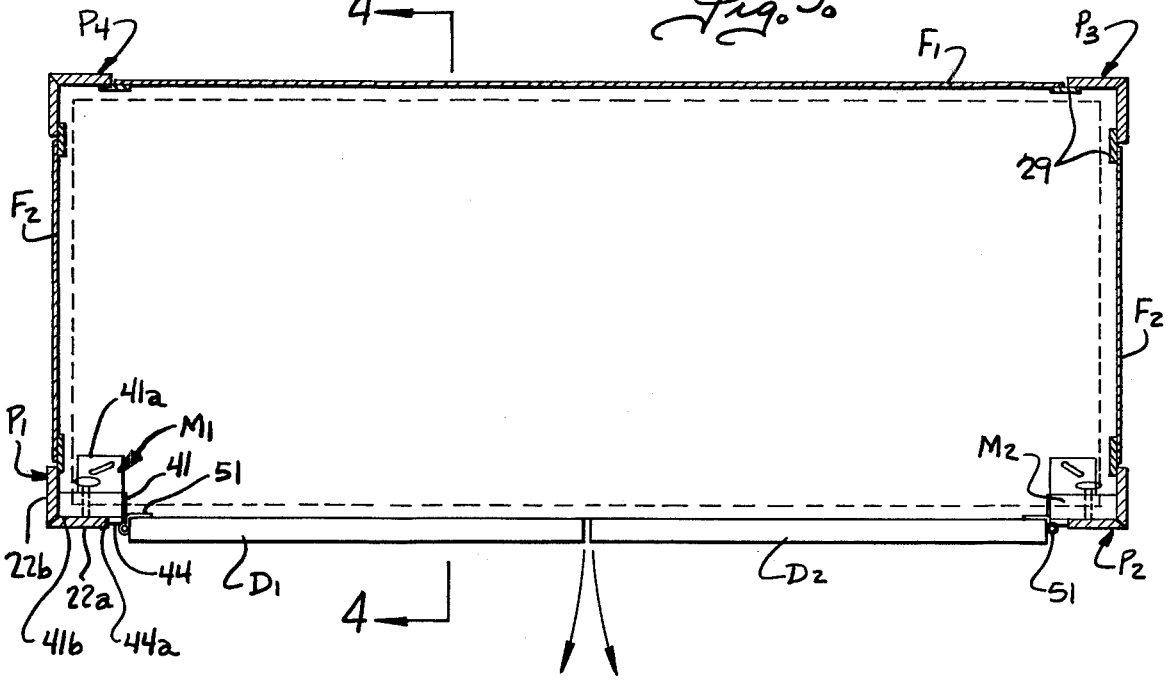
FIG. 3 is a horizontal sectional view taken on the plane 3—3 of FIG. 1.
Figure 4:
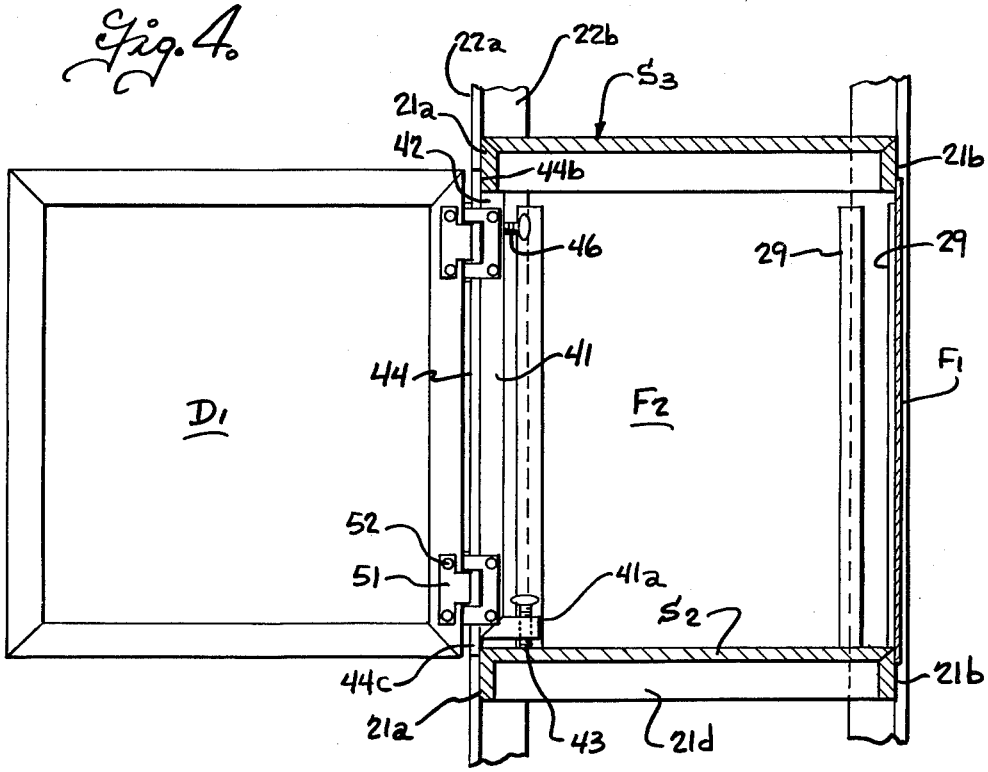
FIG. 4 is a vertical sectional view taken on the plane 4—4 of FIG. 3.

The shelf apparatus including the shelves $\underline{S}_1$–$\underline{S}_4$ and posts $\underline{P}_1$–$\underline{P}_4$ provides an open-type shelf apparatus. The shelf spaces in such an open shelf apparatus can readily be enclosed at the back and sides by removable panels such as back panel $\underline{F}_1$ and end panels $\underline{F}_2$. In the shelf apparatus illustrated, the back panels $\underline{F}_1$ have a width to be loosely received between the legs on adjacent posts $\underline{P}_3$ and $\underline{P}_4$ at one side of the shelf apparatus and a height somewhat greater than the spacing between adjacent ones of the shelves. Similarly, the end panels $\underline{F}_2$ have a width to be loosely received between the posts at the ends of the shelf apparatus and a height somewhat greater than the spacing between the shelves. Strips 29 are secured to the panels $\underline{F}_1$ and $\underline{F}_2$ along opposite side edges and extend outwardly therefrom to overlap the inner sides of the legs on the corner posts. The strips 29 have a length less than the spacing between adjacent shelves and, as shown in FIG. 4, have the lower ends spaced above the lower end of the respective panel a distance to allow the lower edge of the panel to overlap the lower shelf and the upper end spaced from the upper edges of the panel a distance sufficiently greater than the spacing of the spacing of the lower end of the strips from the lower end of the panel to allow the upper edge of the panel to overlap the edge of the upper shelf when the panel is installed. The panels $\underline{F}_1$ and $\underline{F}_2$ can be installed by first inserting the upper end of the panel from the inside of the shelf apparatus into the space between the legs on the posts adjacent the upper shelf while raising the panel, and then moving the panel outwardly until the strips engage the inner sides of the legs on the posts. At that time, the panel can be allowed to drop downwardly until the lower edge of the strips engage the lower shelf and support the panel.

Figure 5:
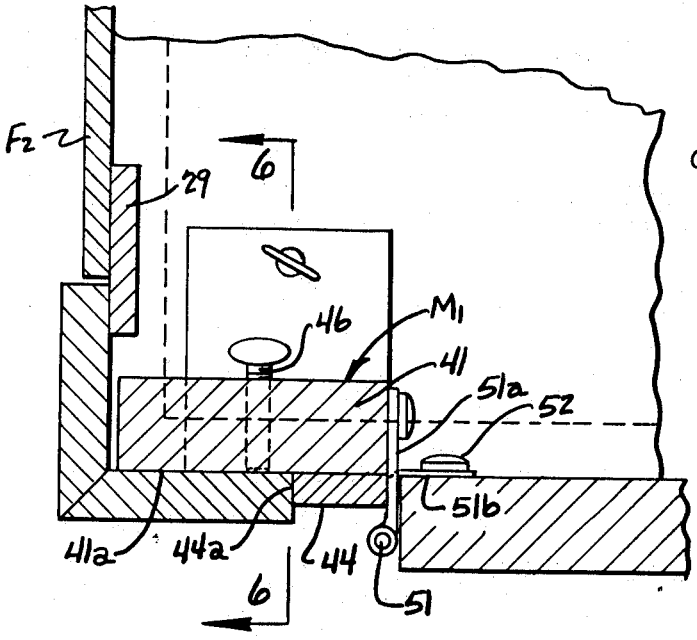
FIG. 5 is a fragmentary horizontal sectional view illustrating the parts on a larger scale.
Figure 6:
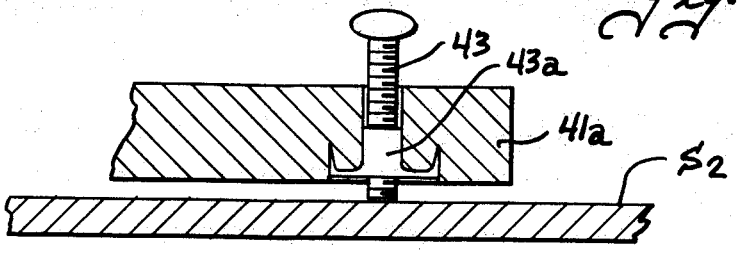
FIG. 6 is a fragmentary vertical sectional view taken on the plane 6—6 of FIG. 5.
Figure 8:
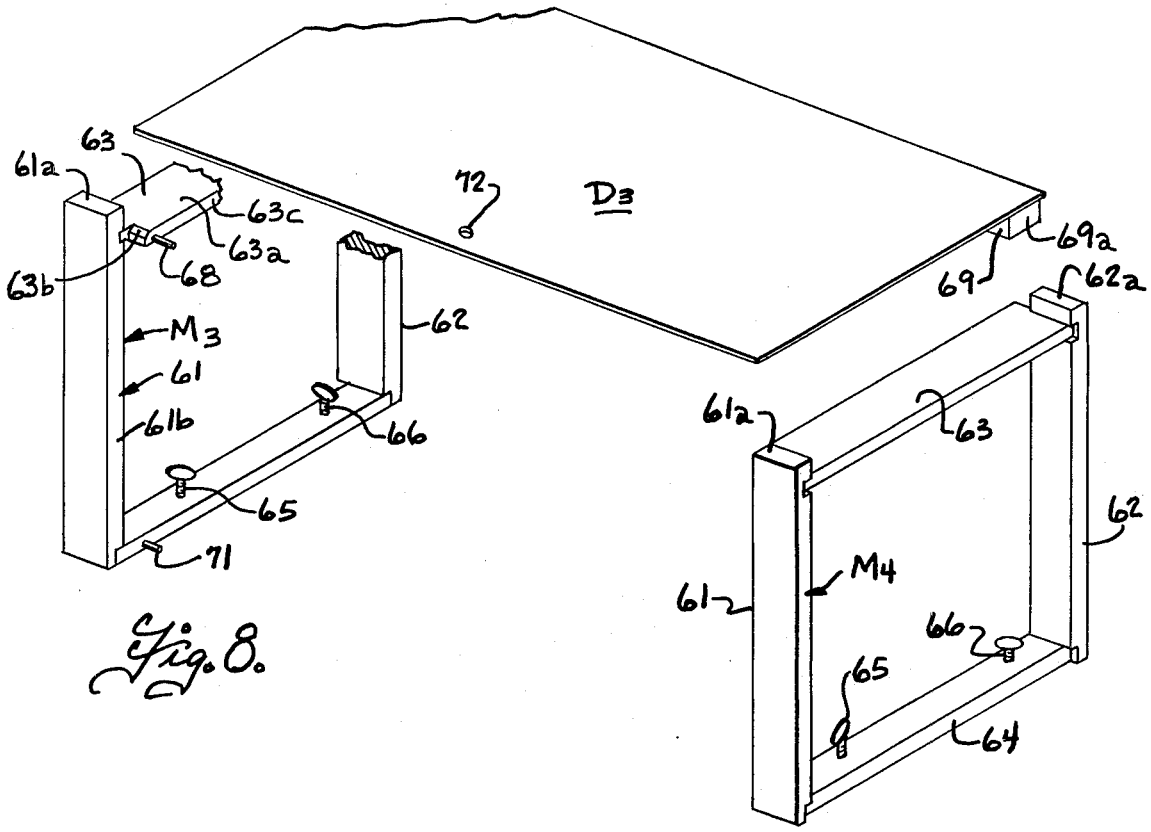
FIG. 8 is an exploded perspective view of a combination swinging and sliding removable door assembly.

In accordance with the present invention, removable door assemblies are provided for the front side of one or more of the shelf spaces in the shelf apparatus. A vertically hinged style removable door assembly is shown in FIGS. 2–5. The shelf spaces are usually long and narrow and it is preferable to use a pair of vertically hinged doors designated $D_1$ and $D_2$ for each shelf space. The doors $D_1$ and $D_2$ are hingedly connected at the left and right ends respectively to door mounting members $M_1$ and $M_2$. The door mounting members $M_1$ and $M_2$ are constructed and arranged so that they can be installed in the space between a pair of vertically spaced shelves without requiring the use of special tools and without requiring modification or drilling of the shelf apparatus. The door mounting members $M_1$ and $M_2$ are similar in construction but mirror images of each other for installation at the left and right sides respectively of the shelf apparatus and like numerals are used to designate corresponding parts. The mounting means $M_1$ and $M_2$ each include an upright door mounting member 41 adapted to extend along the inner side of the front leg of a respective one of the posts $P_1$ and $P_2$. The upright members 41 have a length slightly less than the spacing between adjacent shelves to be receivable therebetween and the door mounting members have an upper abutment 42 adapted to engage the underside of the upper shelf of the pair of shelves and a lower abutment 43 adapted to engage the upper side of the lower shelf of the pair of shelves. At least one of the abutments such as 43 is manually adjustable relative to the member 41 in a vertical direction for adjustably and forcibly increasing the spacing between the upper and lower shelf engaging abutments to jam the door mounting member vertically between the adjacent shelves. As shown, the upright door mounting member has a laterally extending bracket portion 41*a* at its lower end and the lower abutment 43 is in the form of a thumb screw which threadedly engages a nut 43*a* (FIG. 6) anchored in the bracket 41*a* at the lower end of the door mounting member 41. As will be seen, the distal end of the thumb screw 43 engages the upper face of the lower shelf of the shelf pair and tightening of the thumb screw jams the door mounting member vertically between the upper and lower shelves to anchor the door mounting member on the shelf assembly. The door mounting members 41 have a front face 41*b* adapted to extend along the inner side of the leg on the corner post. The door mounting members 41 are also advantageously provided with a strip 44 having a side edge 44*a* disposed perpendicular to the face 41*a* on the door mounting member and arranged to engage the edge of the leg of the respective shelf supporting post, as best shown in FIG. 5. The strip 44 is dimensioned to extend beyond the upper and lower shelf engaging abutments on member 41 to provide lateral abutment faces 44*b* and 44*c* overlie the front edges of the upper and lower shelves, as best shown in FIG. 4. A second manually adjustable means 46 is mounted on the door mounting member for engagement with the inner side of the front leg of the post and is adjustable in a direction transverse to the front leg to forcibly shift the door mounting member laterally of the front leg. As shown in FIGS. 4 and 5, the second manually adjustable means 46 is in the form of a thumb screw which is threadedly mounted in a nut (not shown) on the door mounting member 41. Thumb screw 46 is preferably located adjacent the upper end of the door mounting member so as to press the upper lateral abutment face 44*b* against the front edge of the upper shelf. Thus, the door mounting member is jammed vertically between the upper and lower shelves and is also clamped laterally to the upper shelves and to the adjacent posts, so as to firmly anchor the door mounting member on the shelf apparatus. The doors $D_1$ and $D_2$ are hingedly mounted as by hinges 51 and screw fasteners 52 on the upright door mounting member. The hinges are preferably of the offset type best shown in FIG. 5 having a generally flat hinge plate 51*a* attached to the upright door mounting member 41 and generally L-shaped hinge plate 51*b* secured to the door, to support the door with its inner side substantially coplanar with the face 41*a* on the door mounting member. In this manner, the door can overlie and abut against the front edges of the upper and lower shelves when the door is closed. Alternatively, the door could be rabbeted to provide flanges at the top and bottom to overlie the front edges of the shelves, if desired. Any suitable latch mechanism (not shown) may be provided for holding the doors in a closed position.

Figure 9:
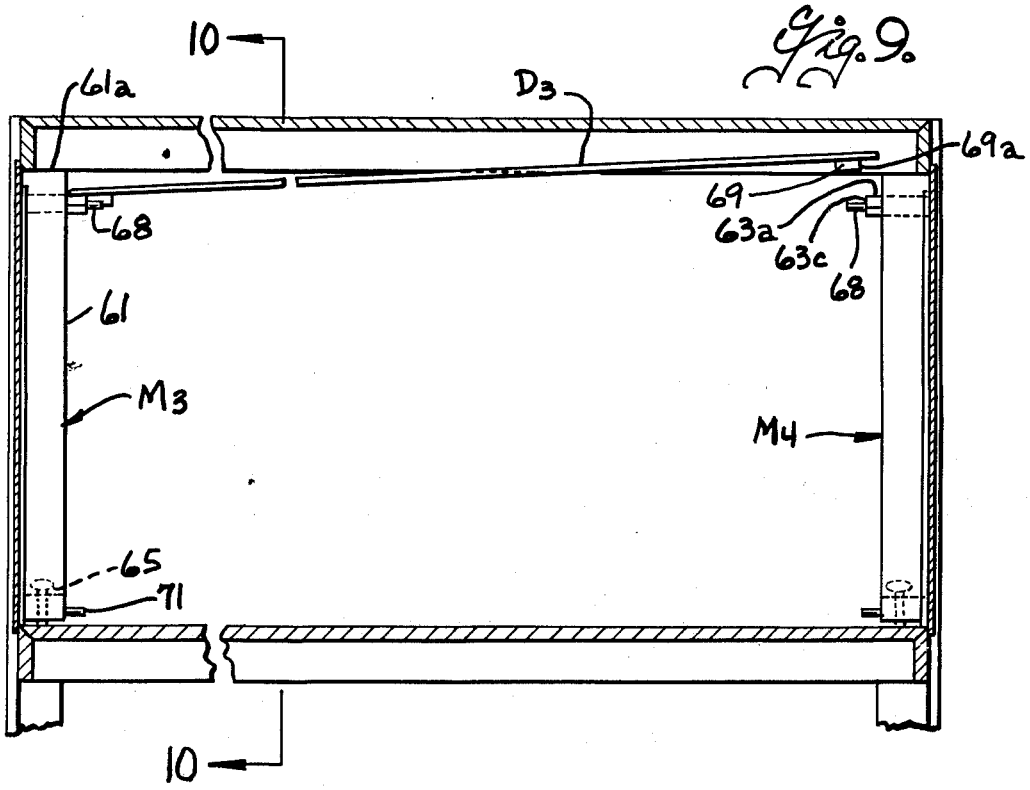
FIG. 9 is a vertical sectional view through the shelf apparatus illustrating installation of the combination swinging and sliding removable door assembly therein.

A removable door assembly arranged for combination swinging and sliding movement is shown in FIGS. 8–13. In this embodiment, a single elongated door $D_3$ is mounted on a pair of door mounting means $M_3$ and $M_4$ for swinging movement between an upright position extending across the front of the shelf opening to a horizontal position, and also for sliding movement while in the horizontal position to a storage position between the shelves. The door mounting means $M_3$ and $M_4$ are of like construction but are mirror images of each other and like numerals are used to designate corresponding parts. The door mounting means $M_3$ and $M_4$ each comprise forward and rear upright members 61, 62 and a generally horizontally disposed door support member 63 attached to the front and rear members and offset below the upper ends thereof. The upright members 61 and 62 are dimensioned to be received between the adjacent shelves of the pair of shelves and the upright members 61 and 62 respectively have upper shelf engaging abutment surfaces 61*a* and 62*a* arranged to engage the underside of the upper shelf of the pair of shelves. Provision is made for jamming the upright members 61 and 62 vertically between the adjacent shelves of the pair and, for this purpose, lower shelf engaging abutments 65 and 66 are mounted as on a cross member 64 attached to the lower ends of the uprights 61 and 62. The lower shelf engaging abutments 65 and 66 are conveniently in the form of thumb screws which are threaded in nuts (not shown) anchored in the cross member 64 and which have their distal ends arranged to engage the lower shelf so that, when the thumb screws are turned, the shelf engaging members 61 and 62 are jammed vertically between the upper and lower shelves to anchor the same to the shelving system. The front uprights 61 are arranged to extend along the inner side of the legs of the respective posts $P_1$ and $P_2$ and preferably have a width such that one edge 61*b* of the front uprights is substantially coplanar with the edge of the leg on the respective post. The generally horizontal door support members 63 extend inwardly from the edges 61*b* to provide ledges designated 63*a* that are adapted to underlie and support the door along opposite ends thereof, when the door is in a horizontal position. Provision is made for supporting the door for swinging movement between an upright position extending across the opening between the shelves and a generally horizontal position and, for this purpose, stop pins 68 are provided on each of the ledges 63*a* adjacent their forward ends and stop members 69 are provided on the door adjacent its upper edge at locations to engage the stop pins 68, when the door is pulled forwardly, and to allow the door to swing downwardly to an upright position as shown in FIG. 10. As will be seen from FIG. 10, the stop pins 68 are spaced above the lower shelf a distance approximating the spacing between the stop means 69 on the door and the lower edge of the door so as to support the door for swinging movement between the upright and horizontal positions. The stop pins 68 are herein shown offset slightly below the door support ledges 63*a* on the members 63 and the forward ends of the door support ledges are chamfered or rounded as shown at 63*b* in FIGS. 11 and 12, to facilitate swinging movement of the door between its vertical and horizontal positions. Stop members 69 are conveniently in the form of blocks of wood or the like attached to the door $\underline{D}_3$ and which have side surfaces 69*a* (FIGS. 8 and 9) spaced apart a distance to guidably engage the inner side edges 63*c* on the members 63, to thereby laterally guide the door during sliding movement therealong. A lower door stop 71, conveniently in the form of a pin, is provided on the member 64 at a location to engage the lower part of the door to limit inward swinging movement as shown in FIG. 10. The door mounting means $\underline{M}_3$ and $\underline{M}_4$ and the door $\underline{D}_3$ can be easily installed and removed from the shelf apparatus without requiring use of tools. One of the door mounting means such as $\underline{M}_3$ is inserted into position between the shelves at one end thereof and the thumb screws 65 and 66 then adjusted to vertically jam the door mounting means between the shelves. Door $\underline{D}_3$ is then positioned between the shelves with one end resting on the ledge 63*a* on the door mounting means $\underline{M}_3$. The other end of the door $\underline{D}_3$ is then raised as shown in FIG. 9 and the other door mounting means $\underline{M}_4$ is then installed between the shelves and locked in position by adjusting the screws 65 and 66. Door $\underline{D}_3$ is then slidable along the ledges 63*a* from a rear or storage position in whch it is disposed between the shelves to a forward position as shown in phantom in FIG. 10. The door can then be swung downwardly to an upright position to close the shelf opening. A door handle, herein shown in the form of a finger receiving opening 72 is provided on the door preferably adjacent the lower central part thereof, to facilitate opening and moving the door.

From the foregoing it is thought that the construction and manner of use of the shelf apparatus with removable door assemblies will be readily understood. The shelf apparatus is preferably of the knock-down type and the shelves can be easily erected on the posts by threaded fasteners 23. The removable door assemblies can be installed in and removed from the shelf apparatus without requiring the use of tools and without modification of the shelf apparatus so that the appearance of the shelf apparatus is not adversely affected if the removable door assemblies are removed or installed in different ones of the shelf openings. The vertically hinged removable door assembly is installed in the shelf apparatus by inserting the door mounting members 41 between the adjacent shelves and alongside the front leg of the respective post. The thumb screws 43 are then tightened to vertically jam the upright door mounting members between the upper and lower shelves. The strips 44 have a side face 44*a* which extends alongside the legs of the posts and also have upper and lower abutment faces 44*b* and 44*c* engaging the front sides of the upper and lower shelves. When the second thumb screw 46 is thereafter tightened, it operates to laterally clamp the door mounting members 41 to the shelves and to the posts.

The combination swinging and sliding door assembly of FIGS. 8–13 is also easily installed and removed from the shelving system without the use of tools. The door mounting means $\underline{M}_3$ and $\underline{M}_4$ are merely inserted between the adjacent shelves with the door $\underline{D}_3$ in overlying position and the thumb screws 65 and 66 tightened to vertically jam the door mounting means between the upper and lower shelves.

The embodiments of the invention in which an exclusive property or privilege is claimed are defined as follows:

1. In a shelf apparatus including an upper shelf and a lower shelf each having depending front and rear flanges and depending end flanges extending between the front and rear flanges, upright shelf support means at each end of the shelves each including end leg means overlapping the end flanges on a respective end of the shelves and front and rear leg means respectively overlapping the front and rear flanges on the shelves adjacent the ends thereof, and means rigidly securing the shelf support means to the shelves to support the same in fixed vertically spaced relation, a removable door assembly including upright door mounting means removably positioned between the upper and lower shelves and having a portion extending alongside the inner side of the front leg of one of the shelf support means and having upper and lower shelf engaging abutment means respectively adapted to engage the depending front flange on the upper shelf and the upper surfce of the lower shelf, manually operable means for adjustably and forcibly increasing the spacing between the upper and lower shelf engaging abutment means to jam the door mounting means vertically between the upper and lower shelves, and a door mounted on said door mounting means for movement relative thereto.

2. In a shelf apparatus including an upper shelf and a lower shelf each having a forward edge, upright shelf support means attached to the shelves and extending therebetween to support the shelves in fixed vertically spaced relation, each of said shelf support means having a vertical front leg extending across the front edge of each the upper and lower shelves, a removable door assembly including upright door mounting means removably positioned between the upper and lower shelves alongside one of the shelf support means and having upper and lower shelf engaging abutment means adapted to engage opposed surfaces on the upper and lower shelves, manually operable means for adjustably and forcibly increasing the spacing between the upper and lower shelf engaging abutment means to jam the door mounting means vertically between the upper and lower shelves, a door mounted on said door mounting means for movement relative thereto, said upright door mounting means being adapted to extend along the inner side of said vertical front leg of said one of said shelf support means and said upright door mounting means having upper and lower lateral abutment portions overlapping the front edge of the upper and lower shelves respectively adjacent said vertical front leg of said one of said shelf support means, and a second manually adjustable means on said upright door mounting means engageable with the inner side of front leg and adjustable in a direction transverse to said inner side of said front leg for forcibly shifting said door mounting means laterally of said front leg whereby to press said lateral abutment portions against the front edge of the upper and lower shelves.

3. In a shelf apparatus including an upper shelf and a lower shelf each having a front edge, upright shelf support means attached to the shelves and extending therebetween to support the shelves in fixed vertically spaced relation, each of said shelf support means having a vertical front leg extending across the front edge of each the upper and lower shelves, a removable door assembly including upright door mounting means removably positioned between the upper and lower shelves alongside one of the shelf support means and having upper and lower shelf engaging abutment means adapted to engage opposed surfaces on the upper and lower shelves, manually operable means for adjustably and focibly increasing the spacing between the upper and lower shelf engaging abutment means to jam the door mounting means vertically between the upper and lower shelves, and a door mounted on said door mounting means for movement relative thereto, said upright door mounting means having a first vertically extending portion adapted to extend along the inner side of said vertical front leg of said one of said shelf support means and a second vertically extending portion disposed in a plane perpendicular to said first vertically extending portion to extend along a vertical edge of said vetical front leg of said one of said shelf support means, said upright door mounting means having upper and lower lateral abutment portions overlapping the front edge of the upper and lower shelves respectively adjacent said front leg, and a second manually adjustable means on said upright door mounting means engageable with the inner side of the front leg and adjustable in a direction transverse to said inner side of said front leg for forcibly shifting the door mounting means laterally of said front leg whereby to press said lateral abutment portions against the front edge of said upper and lower shelves.

4. A shelf apparatus according to claim 1 wherein said door is hingedly mounted on said door mounting means for swinging movement relative thereto about an upright axis.

5. A shelf apparatus according to claim 1 wherein said door is mounted on said door mounting means for swinging movement relative thereto about a horizontal axis adjacent the upper end of said door mounting means.

6. A shelf apparatus according to claim 1 wherein said door is mounted on said door mounting means for combination swinging movement about a horizontal axis adjacent the upper end of said door mounting means between an upright position and a generally horizontal position and for sliding movement along a horizontal path between said shelves and adjacent the level of said pivot axis, when the door is in said horizontal position, said door mounting means including means for slidably supporting said door for movement along said horizontal path.

7. A shelf apparatus according to claim 1 wherein said manually operable means comprises a vertically disposed thumb screw threadedly mounted on said door mounting means, the distal end of said thumb screw being one of said shelf engaging abutment means.

8. In a shelf apparatus including an upper shelf and a lower shelf and L-shaped corner posts each having a pair of angularly related leg overlapping the edges of the first and second shelves adjacent the corners thereof and rigidly secured to the shelves to support the same in fixed vertically spaced relation, a removable door assembly including upright door mounting member removably positioned between the first and second shelves along the inner side of one leg of one of the corner posts and having upper and lower shelf engaging abutment means at opposite ends adapted to engage opposed surfaces on the first and second shelves, a first manually operable means for adjustably and forcibly increasing the spacing between said upper and lower shelf engaging abutment means to jam the door mounting means vertically between the first and second shelves, a door hingedly mounted on said door mounting member for swinging movement relative thereto about an upright axis alongside said door mounting member, and an upright stop member rigid with said door mounting member, said stop member extending along the edge of said one leg and having lateral abutments adjacent opposite ends engageable with the edges of the shelves adjacent said one leg, and a second manually adjustable means on the upright door mounting member engageable with the inner side of said one leg and adjustable in a direction transverse to said one leg for forcibly shifting the door mounting member laterally of said front leg whereby to press at least one of said lateral abutments against the edge of a shelf.

9. A shelf apparatus according to claim 8 wherein said first manually operable means comprises a vertically disposed first thumb screw threadedly mounted on said door mounting member, the distal end of said first thumb screw being one of said shelf engaging abutment means.

10. A shelf apparatus according to claim 9 wherein said first thumb screw is mounted on the lower end of the door mounting member, and said second manually adjustable means comprises a horizontally disposed second thumb screw threadedly mounted on said door mounting member intermediate the ends thereof, the distal end of said second thumb screw being engageable with the inner side of said one leg.

11. In a shelf apparatus including an upper shelf and lower shelf each having depending front and rear flanges and depending end flanges extending between the front and rear flanges, upright shelf support means at each end of the shelves and each including end leg means overlapping the end flanges on a respective end of the shelves and a front and rear leg means respectively overlapping the front and rear flanges on the upper and lower shelves adjacent the corners thereof, and means rigidly securing the shelf support means to the shelves to support the same in fixed vertically spaced relation, a removable door assembly including left and right upright door mounting frames removably positioned between the upper and lower shelves adjacent opposite ends thereof, the door mounting frames extending along the inner sides of the end leg means and front leg means of the respective shelf support means and having upper and lower shelf engaging abutment means respectively adapted to engage the depending front flange on the upper shelf and the upper surface of the lower shelf, manually operable means for adjustably and forcibly increasing the spacing between the upper and lower shelf engaging abutment means to jam the door mounting frames vertically between the upper and lower shelves, a door dimensioned to extend between the left and right frames, means on said left and right frames supporting the door for combination swinging movement about a horizontal axis adjacent the upper end of the door mounting frame between the upright position and a generally horizontal position and for sliding movement along a horizontal path below said upper shelf and adjacent the level of said pivot axis when the door is in said horizontal position, said last mentioned means including a generally horizontal ledge on each door mounting frame spaced below the upper shelf and each adapted to underlie a respective end of the door when it is in a horizontal position to slidably support the same, a stop pin extending inwardly of each ledge adjacent one end thereof, and stop members on said door engageable with said stop pins to control door swinging movement of the door between said upright and said horizontal positions, said stop members moving with said door away from said stop pins as the door slides along said ledges.

12. A shelf apparatus according to claim 11 wherein said stop members have guide surfaces engageable with the ledges to laterally guide the door during sliding movement along the ledges.

13. In a shelf apparatus including an upper shelf and a lower shelf and a plurality of L-shaped corner posts each having a pair of angularly related legs overlapping the edges of the upper and lower shelves adjacent the corners thereof and rigidly secured to the shelves to support the same in fixed vertically spaced relation, a removable door assembly including upright door mounting member removably positioned between the upper and lower shelves along the inner side of one leg of one of the corner posts, an upright stop member rigid with said door mounting member, said stop member extending along the edge of said one leg and having lateral abutments adjacent opposite ends engageable with the edges of the shelves adjacent said one leg, manually adjustable means on the upright door mounting member engageable with the inner side of said one leg and adjustable in a direction transverse to said one leg for forcibly shifting the door mounting member laterally of said front leg whereby to press at least one of said lateral abutments against the edge of a shelf, and a door hingedly mounted on said door mounting member for swinging movement relative thereto about an upright axis alongside said door mounting member.

14. A shelf apparatus according to claim 13 wherein said manually adjustable means comprises a horizontally disposed thumb screw threadedly mounted on said door mounting member intermediate the ends thereof, the distal end of said thumb screw being engageable with the inner side of said one leg.

15. In a shelf apparatus including an upper shelf and lower shelf each having depending front and rear flanges and depending end flanges extending between the front and rear flanges, upright shelf support means at each end of the shelves each including end leg means overlapping the end flanges on a respective end of the shelves and front and rear leg means respectively overlapping the front and rear flanges of the upper and lower shelves adjacent the corners thereof, and means rigidly securing the shelf support means to the shelves to support the same in fixed vertically spaced relation, a removable door assembly including left and right upright door mounting frames removably positioned between the upper and lower shelves adjacent opposite ends thereof, each frame being supported on the lower shelf and having portions extending along the inner sides of the front and rear leg means of a respective shelf support means to be located thereby, a door dimensioned to extend between the left and right frames, means on said left and right frames supporting the door for combination swinging movement about a horizontal axis adjacent the upper end of the door mounting frame between an upright position and a generally horizontal position and for sliding movement along a horizontal path below said upper shelf and adjacent the level of said pivot axis when the door is in said horizontal position, said last mentioned means including a generally horizontal ledge on each frame spaced below the upper shelf and each adapted to underlie a respective end of the door when it is in a horizontal position to slidably support the same, a stop pin extending inwardly of each ledge adjacent one end thereof, and stop members on said door engageable with said stop pins to control door swinging movement of the door between said upright and said horizontal positions, said stop members moving with said door toward and away from said stop pins as the door slides respectively forwardly and rearwardly along said ledges.

16. In a shelf apparatus including an upper shelf and a lower shelf each having depending front and rear flanges and depending end flanges extending between the front and rear flanges, upright shelf support means at each end of the shelves each including end leg means overlapping the end flanges on a respective end of the shelves and front and rear leg means respectively overlapping the front and rear flanges of the upper and lower shelves adjacent the corners thereof, and means rigidly securing the shelf support means to the shelves to support the same in fixed vertically spaced relation, a pair of removable door assemblies each including an upright door mounting member extending along the inner side of the front leg of a respective one of the shelf support means between the top of the lower shelf and the depending front flange on the upper shelf, an upright stop member rigid with each door mounting member, each stop member extending along the edge of the front leg means of a respective one of the shelf support means and having a lateral abutment on one end engageable with the front flange on one of the shelves, manually adjustable means on each upright door mounting member engageable with the inner side of the front leg of the respective shelf support means and adjustable in a direction transverse to that front leg for forcibly shifting the door mounting member laterally of said front leg whereby to press said lateral abutment against the front flange on said one of said shelves, and a door hingedly mounted on each door mounting member for swinging movement relative thereto about an upright axis alongside the door mounting member.

* * * * *